United States Patent [19]

Daily

[11] 4,091,548

[45] May 30, 1978

[54] DOOR MOUNTED STATIONARY DRYING RACK

[75] Inventor: Thomas Edward Daily, Herrin, Ill.

[73] Assignee: Fedders Corporation, Edison, N.J.

[21] Appl. No.: 740,556

[22] Filed: Nov. 10, 1976

[51] Int. Cl.[2] ..... F26B 9/00

[52] U.S. Cl. ..... 34/133; 34/197; 34/202; 312/311

[58] Field of Search ..... 34/68, 90, 103, 133, 34/197, 202, 238; 312/236, 311

[56] References Cited

U.S. PATENT DOCUMENTS

| | | | |
|---|---|---|---|
| 523,686 | 7/1894 | Sampson | 34/238 |
| 2,353,827 | 7/1944 | Huebsch, Jr. | 34/133 |
| 2,628,432 | 2/1953 | Morrison | 34/68 |
| 3,316,659 | 5/1967 | Lauck | 34/133 |
| 3,344,532 | 10/1967 | Bigler | 34/133 |

*Primary Examiner*—John J. Camby
*Assistant Examiner*—Larry I. Schwartz
*Attorney, Agent, or Firm*—McAulay, Fields, Fisher & Goldstein

[57] ABSTRACT

A drying rack that is adapted to maintain selected articles stationary while a clothes dryer executes a tumble dry cycle. The rack comprises an open latticework basket pivotally mounted on the front door of the dryer by a bracket. The bracket is sized to position the basket within the interior of the drum when the door is closed and to position the basket outside the drum when the door is in the open position. The basket pivots as the door is moved from the open to the closed position so that the open top of the basket always remains uppermost.

9 Claims, 4 Drawing Figures

FIG. 1
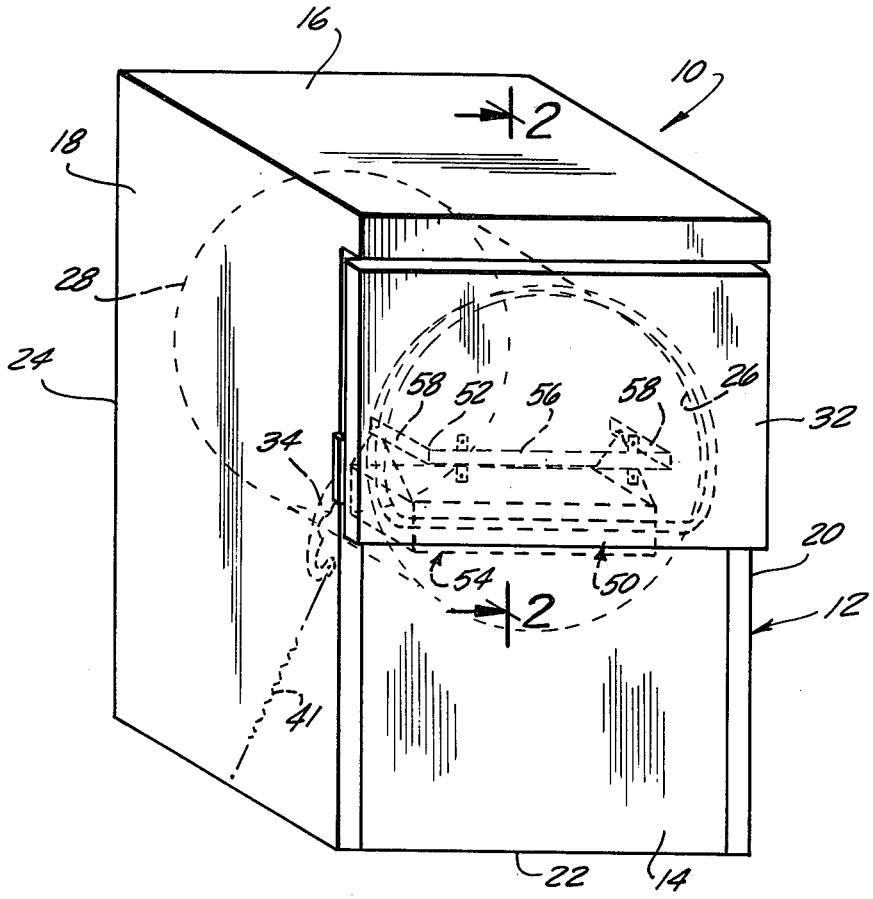
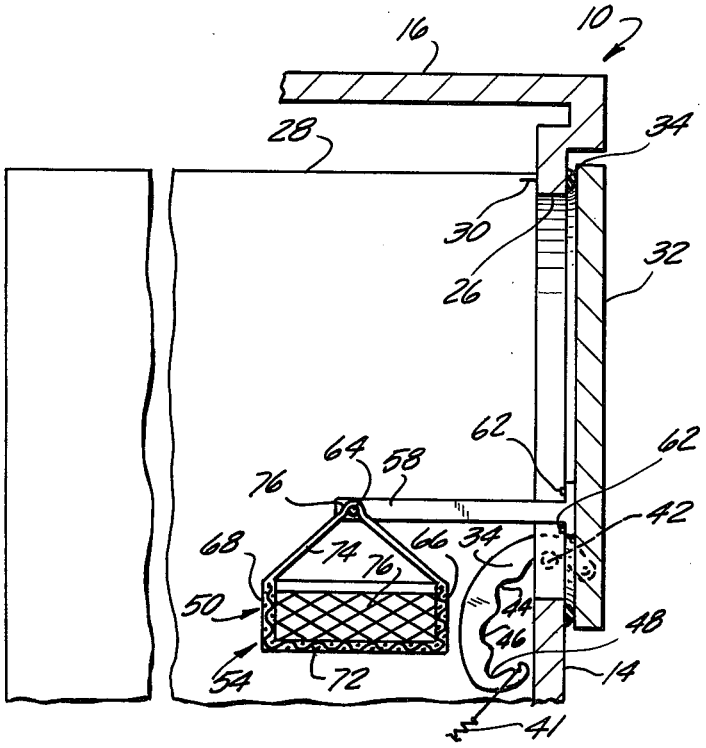
FIG. 2

DOOR MOUNTED STATIONARY DRYING RACK

This invention relates generally to an improved appliance construction and, more particularly, pertains to a clothes dryer construction that is adapted to maintain articles stationary during a drying cycle.

Most clothes dryers presently being manufactured are of the tumble dry type. That is, the dryers contain a rotatable drum that continuously moves the clothes while the hot air circulates through the drum. However, in some cases, it is desirable to maintain articles stationary during the drying cycle.

Accordingly, an object of the present invention is to provide a stationary drying rack for a dryer construction.

A more specific object is to provide, in a dryer construction of the type having a rotating drum, a rack to maintain articles stationary.

A further object of the present invention resides in the novel details of construction that provide a rack in a dryer construction of the type described, which is conveniently moved into and out of the interior of the drum so that hot air circulates through the articles received therein.

Accordingly, a rack constructed according to the present invention is to be utilized in conjunction with a dryer construction of the type having a rotatable drum within a housing for tumble drying articles received therein. The housing is provided with an access door to provide access to the interior of the drum. The rack is movable into the drum for maintaining selected articles stationary during a tumble dry cycle of operation of the dryer. The rack comprises a basket having an open top for receiving articles therein. Bracket means is adapted to support the basket on the door and in spaced relationship thereto so that the basket is received into the interior of the drum when the door is closed and is spaced therefrom to provide ease of loading and unloading when the dryer door is in the open position.

Other features and advantages of the present invention will become more apparent from a consideration of the following detailed description when taken in conjunction with the accompanying drawings, in which:

FIG. 1 is a perspective view of a dryer construction incorporating the rack of the present invention, with the dryer in the door closed position and the rack received within the interior of the drum for a drying operation;

FIG. 2 is a sectional view taken along the line 2—2 of FIG. 1;

Figure 3:
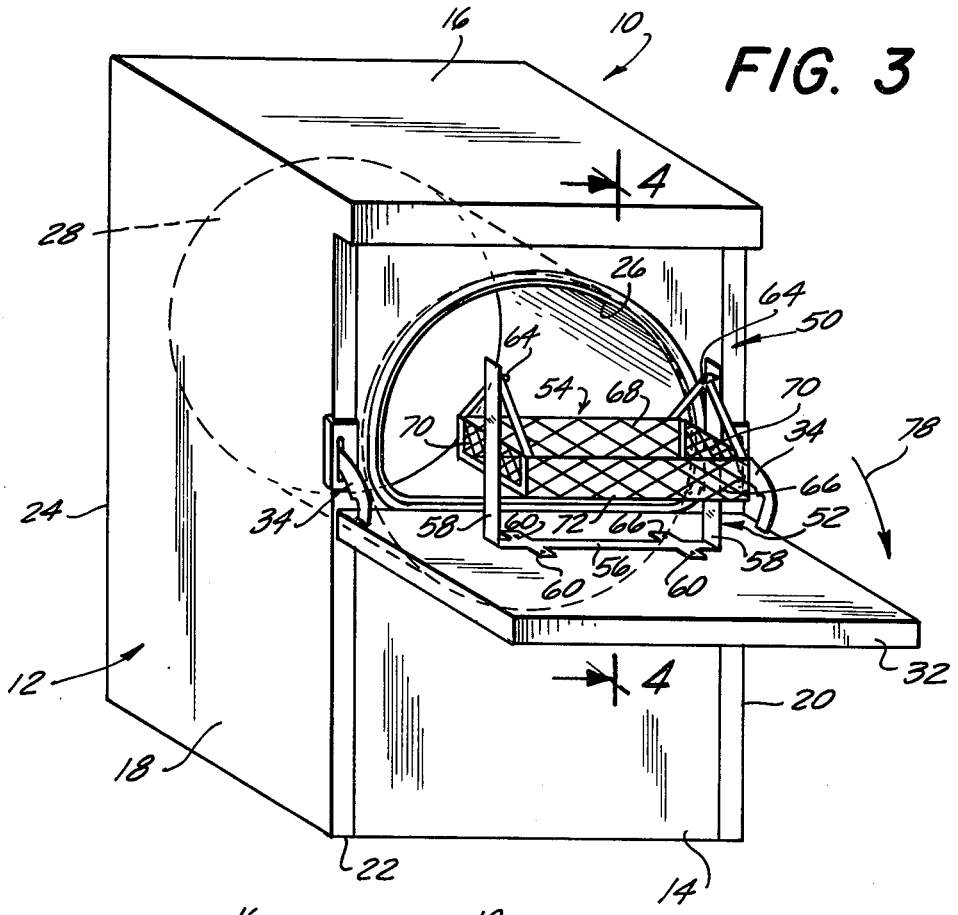
FIG. 3 is a perspective view similar to FIG. 1 with the dryer in the door-open position and the rack shown positioned outside of the dryer for loading or unloading the same.

Accordingly, a clothes dryer constructed according to the present invention is designated generally by the reference numeral 10 in the figures and is illustrated diagrammatically therein. The dryer 10 is conventional in construction with the exceptions noted below. Accordingly, the elements of the dryer per se are not shown in detail. Only those portions of the dryer necessary for an understanding of the present invention are disclosed.

Accordingly, the dryer 10 comprises a cabinet 12 having a front wall 14, a top wall 16, opposed side walls 18 and 20, a bottom wall 22 and rear wall 24. The front wall 14 of the cabinet or housing 12 is provided with a substantially semicircular opening 26 to provide access to the interior of the dryer. A drum 28 is rotatably mounted, by appropriate means (not shown) within the interior of the cabinet. A peripheral flange 30 is provided on the inner surface of the front wall 14 and extends into the open front end of the drum 28.

As is conventional in dryers of the type thus-far described, the drum 28 is rotated within the cabinet or housing 12 by conventional driving means (not shown), such as by a motor in driving relationship with a drive belt that surrounds the drum, while hot air is circulated through the drum. The clothes received within the drum are moved about due to the rotating action of the drum thereby exposing greater surface areas of the articles to the hot air. This is commonly referred to as a tumble dry operation or cycle.

The opening 26 is adapted to be closed by a door 32. The door is hingedly connected to the front wall 14 adjacent its bottom edge by a hinge (not shown). A gasket 34 surrounds the opening 26 and provides a seal between the door 32 and the front wall 14 when the door is in the closed position.

Figure 4:
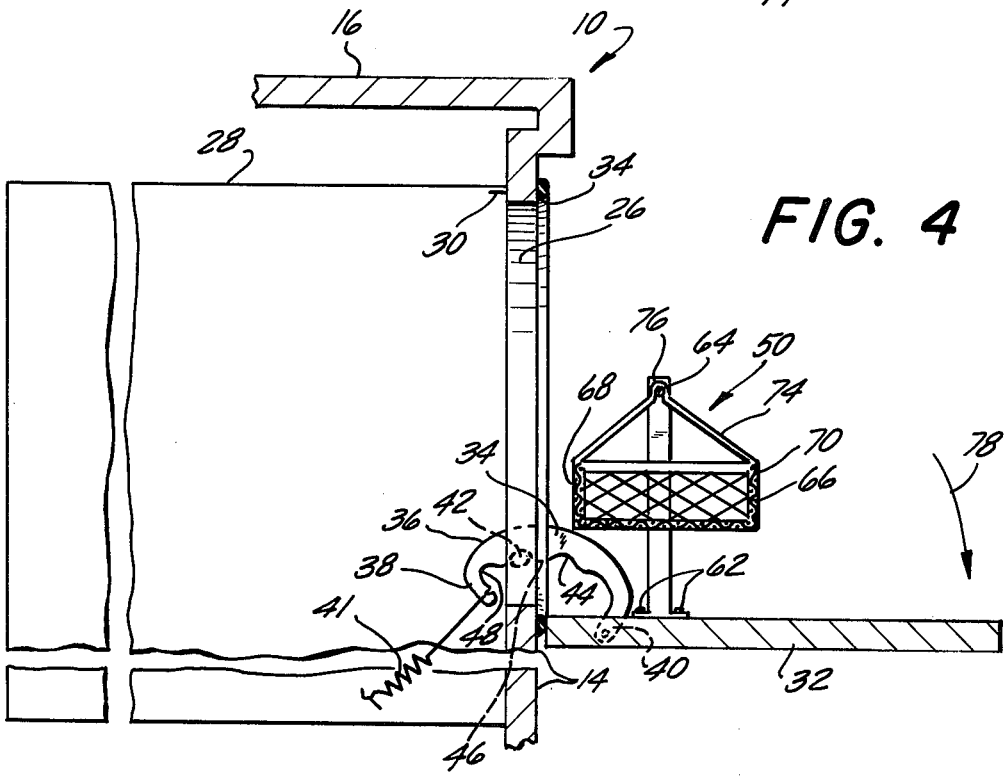
FIG. 4 is a sectional view taken along the line 4—4 of FIG. 3.

The door 32 is adapted to be moved from the closed position to a plurality of different open positions wherein the door is oriented in different angular relationships with respect to the front wall. That is, the door may be opened to a 45° angle, a 90° angle, or a 180° angle. The opening of the door is controlled by brackets 34 connected to each side of the door. More specifically, the outer surface 36 of the bracket is substantially arcuate in shape and the bracket is provided with inturned ends 38 and 40. The end 40 is pivotally connected to the door 32 and the end 38 of the bracket is connected by a spring 41 to the interior of the housing or cabinet. The inner surface of the bracket rides on a roller 42 and is provided with circumferentially spaced recesses 44, 46 and 48. The recesses 44–48 are positioned to correspond to the angular orientation of the door. Thus, when it is desired to open the door to the 90° position, as shown in FIG. 4, the door is opened until the roller 42 is received within recess 46. At this point, the weight of the door is counterbalanced by the spring 41 which maintains the roller 42 within the recess 46 so that the operator need not hold the door in this position. Similar comments apply to the recesses 44 and 48 which respectively serve to orient the door in the 45° and 180° positions.

In accordance with the present invention, a rack designated generally by the reference character 50 is mounted on the inner surface of the door 32. To be more specific, the rack 50 comprises a mounting bracket 52 and a basket 54 supported on the bracket 52. The bracket 52 comprises a foot portion 56 and opposed upturned arms 58. Tabs 60 extend laterally from the foot portion 56 and are connected to the inner surface of the door 32 by connecting means such as thumb screws 62, spring clips, hooks or the like. In other words, the bracket 52 is releasably connected to the door 32 by means that facilitates its easy and quick separation from the door. Pivot pins 64 are provided on the inner surface of the arms 58 adjacent the upper ends thereof.

The basket 54 is of open latticework construction and comprises a front wall 66, a rear wall 68, opposed side walls 70, and a bottom wall 72. The basket has an open top to facilitate loading and unloading the same with the articles that are to remain stationary. The basket may be fabricated from criss-crossed metal rods or the like, it being understood that the walls comprising the basket should have large openings to facilitate air flow through the basket.

The basket is supported on the bracket 52 by arms 74 which are triangularly shaped as viewed from the side and which extend from the front wall 66 to the rear wall 68 and are positioned adjacent each end wall 70. The arms 74 are provided with a hook portion 76 at the apex thereof which receives the associated pivot pin 64 therein so that the basket 54 pivots with respect to the arms 58. The bottom of the hook portion 76 is open to facilitate removal of the basket, in the manner noted below.

In operation, the door 32 may be moved in the direction indicated by arrowhead 78 in FIGS. 3 and 4 from the closed position to the 90° open position. If it is desired to introduce clothes into the drum 28, the basket 54 and the supporting bracket 52 may be removed from the door by disengaging the bracket 52 from the door (i.e., by releasing the screws, hooks, etc. as the case may be).

Thereafter, the basket and bracket are replaced on the door by reversing the above procedure. The basket may then be filled with those articles that are to be put through a stationary dry cycle. Thereafter, the door 32 is pivoted to the closed position shown in FIGS. 1 and 2. Since the basket 54 is pivotally mounted on the arms 58, as the door 32 is moved to the closed position, the basket will pivot due to the weight of the basket and the articles therein so that the open top of the basket always remains uppermost. This insures that the articles placed into the basket will remain therein. Thus, with the door fully closed, the basket 54 will be oriented in the position indicated by FIGS. 1 and 2.

It is to be noted that the bracket 52 is sized and positioned so that the basket 54 is in spaced relationship to the door when the door is in the open or in the closed position thereby insuring that the basket will clear the door as it pivots about the pins 64. Additionally, the arms 58 are of sufficient length to insure that the basket will be received within the interior of the drum 28 when the door 32 is moved to the closed position. In other words, when the door 32 is in the open position, the basket 54 is easily accessible for loading and unloading purposes. However, when the door is moved to the closed position, the basket is received within the interior of the drum to insure that the articles received therein will be dried.

Accordingly, those articles received within the basket 54 will go through a stationary dry cycle. After the cycle of operation, the door 32 is opened and the articles in the basket 54 may be removed. The basket and the bracket may then be removed from the door so that the dryer can be used for a tumble dry operation.

Accordingly, a dryer construction incorporating a stationary dry rack has been disclosed which permits a stationary dry cycle to be performed on selected articles.

While a preferred embodiment of the invention has been shown and described herein, it will become obvious that numerous omissions, changes and additions may be made in such embodiment without departing from the spirit and scope of the present invention.

What is claimed is:

1. In a dryer construction of the type having a rotatable drum within a housing for tumble drying articles received therein, wherein the housing has an access door for the drum; a rack movable into said drum for maintaining selected articles stationary during a cycle of operation of the dryer; said rack comprising a basket having an open top for receiving articles therein; and bracket means adapted to support said basket on said door and in spaced relationship thereto, whereby said basket is received into the interior of the drum when the door is closed, said bracket means comprising pivot means for pivotally supporting said basket, whereby said basket pivots as the door is moved between open and closed positions to maintain said open top uppermost.

2. A dryer rack as in claim 1, in which said basket comprises an open cage of lattice construction.

3. A dryer rack as in claim 1, in which said bracket means further comprises a basket support and connecting means for releasably connecting said basket support to the access door.

4. A dryer rack as in claim 3, in which said basket support comprises opposed arms adapted to be connected to the door and extending inwardly therefrom when the door is in a closed position, and said pivot means comprises a pivot pin at the end of each of said arms, and a pair of spaced arms on said basket each having a hook portion receiving a respective pivot pin to pivotally mount said basket on said arms.

5. A dryer rack as in claim 1, in which said basket comprises walls formed of criss-crossed metal rods forming a latticework, whereby said walls have a plurality of large openings to permit free air flow through said basket during a cycle of operation of the dryer.

6. A clothes dryer comprising a housing having a rotatable drum therein for the tumble drying of articles received therein; said housing including a door movable between closed and open positions to permit access to the interior of said drum; and rack means received in said drum for maintaining articles stationary during a drying cycle; said rack means comprising a basket having an open top for receiving articles therein; and a bracket mounting said basket on said door and in spaced relationship thereto so that said basket is received in the interior of said drum when said door is in the closed position, and is spaced outside of said drum when said door is in the open position said bracket comprising pivot means for pivotally supporting said basket, whereby said basket pivots as the door is moved between open and closed positions to maintain said open top uppermost.

7. A clothes dryer as in claim 6, in which said basket comprises a latticework cage having large openings to facilitate air flow across the articles in said basket.

8. A clothes dryer as in claim 6, in which said bracket comprises a pair of opposed arms which are sized to project into the interior of said drum when said door is in the closed position, and which project upwardly when said door is in the open position, and connecting means for releasably connecting said arms with said door.

9. A clothes dryer as in claim 8, in which said pivot means comprises a respective pin on each one of said arms, and a pair of arms on said basket each having a portion receiving a respective pivot pin therein to pivotally mount said basket on said bracket.

* * * * *